US005926439A

United States Patent [19]

Piquette

[11] Patent Number: 5,926,439

[45] Date of Patent: Jul. 20, 1999

[54] FLEXTENSIONAL DUAL-SECTION PUSH-PULL UNDERWATER PROJECTOR

[75] Inventor: Jean C. Piquette, Portsmouth, R.I.

[73] Assignee: The United States of America as represented by the Secretary of the Navy, Washington, D.C.

[21] Appl. No.: 09/226,626

[22] Filed: Dec. 21, 1998

[51] Int. Cl.[6] ..... H04R 17/00

[52] U.S. Cl. ..... 367/161; 310/337; 367/141

[58] Field of Search ..... 367/160, 161, 367/165, 141; 310/337

[56] References Cited

U.S. PATENT DOCUMENTS

| | | | |
|---|---|---|---|
| 3,725,856 | 4/1973 | Chervenak | 367/141 |
| 4,878,207 | 10/1989 | Jandera et al. | 367/155 |
| 4,964,106 | 10/1990 | Bromfield | 367/165 |
| 4,970,706 | 11/1990 | Tocquet et al. | 367/158 |
| 5,345,428 | 9/1994 | Arnold et al. | 367/165 |
| 5,359,252 | 10/1994 | Swift et al. | 310/328 |
| 5,493,165 | 2/1996 | Smith et al. | 310/328 |

*Primary Examiner*—Ian J. Lobo
*Attorney, Agent, or Firm*—Michael J. McGowan; Prithvi C. Lall; Michael F. Oglo

[57] ABSTRACT

The present invention relates to an underwater acoustic projector comprising a housing formed from a rigid material, a fixed plate secured to the housing, first and second annular electrostrictive rings positioned on one side of the fixed plate, and third and fourth annular electrostrictive rings positioned on a second side of the fixed plate. The first and second annular rings are separated by a first moving plate, while the third and fourth annular rings are separated by a second moving plate. Each moving plate is connected to a drive piston which contacts an inner surface of an outer housing surrounding the inner housing. The outer housing is caused to move in a flexural mode by the drive pistons in contact with it. The annular rings are formed from lead magnesium niobate or lead magnesium niobate-lead titanate and are wired for dual push-pull operation to reduce the non-linearity of the response of the annular rings.

11 Claims, 2 Drawing Sheets

FLEXTENSIONAL DUAL-SECTION PUSH-PULL UNDERWATER PROJECTOR

STATEMENT OF GOVERNMENT INTEREST

The invention described herein may be manufactured and used by or for the Government of the United States of America for governmental purposes without the payment of royalties thereon or therefor.

BACKGROUND OF THE INVENTION

1. Field of the Invention

The invention relates to underwater acoustic projectors and is directed more particularly to a projector of the type commonly referred to as a "push-pull" acoustic projector.

2. Description of the Prior Art

Acoustic projectors typically are used to produce high-power low-frequency sounds in the ocean or other water bodies. It generally is desired to be able to generate hundreds of watts of omnidirectional acoustic power with a device that can be deployed from an aircraft, surface vessel, or submarine.

Examples of such devices are shown in U.S. Pat. Nos. 4,706,230 to Inoue et al., 4,964,106 to Bromfield, 4,970,706 to Tocquet et al., and 5,345,428 to Arnold et al. The Inoue et al. patent illustrates an underwater low-frequency ultrasonic wave transmitter in which non-active columnar members are disposed on both sides of an active columnar member consisting of a piezoelectric ceramic material or a magnetically strainable material. Levers are connected to the active and non-active columnar members via first and second hinges. Convex shells are connected to the levers via third hinges. The displacement of the active columnar member is enlarged via the lever action, thereby enabling a miniaturized ultrasonic wave transmitter having high power capability.

The Bromfield patent relates to a flextensional sonar transducer assembly which includes a stack of piezoelectric elements disposed along a linear axis, a plurality of electrodes disposed between the elements, end pieces disposed at each end of the piezoelectric stack, with the end pieces having outwardly facing, generally arcuate surfaces, a compression band formed into a loop to encircle the stack and end pieces, a flexural shell disposed to circumscribe the compression band to present a generally elliptical side cross-section, with the major axis thereof being generally coincident with the linear axis of the stack, and with the shell being reactively coupled to the arcuate end portions of the compression band, and rod members positioned between the compression band and the arcuate end portions of the band of material for maintaining driving contact between the shell and the end pieces, and for adjusting the prestress compression pressure in the stack.

The Tocquet et al. patent relates to a flextensor transducer which includes at least one pillar of piezoelectric cells placed within an impervious shell. Each pillar is supported solely by a first end on the shell and is compressed on the shell by a counter mass applied to its second end.

The Arnold et al. illustrates a low frequency flextensional transducer for underwater use which comprises a number of spaced piezoelectric element stacks between opposed inserts. A Kevlar compression band is wound around the stacks and inserts and then partly elliptical plaster formers are attached. A filament wound elliptical flexural shell is then wound around the assembly while controlling the tension so as to provide the required prestress on the piezoelectric stacks when cured. After curing the plastic formers are removed. End plates are attached to the elliptical shell to complete the transducer. The shell has a compression bonded layer of neoprene applied, including a peripheral serrated lip seal to seal against the end plate while permitting flexing of the shell.

In order to create high-power acoustic tones in water at low frequencies, it has been found that a device must be able to produce large volume displacements. The volume displacement is the integral of the normal displacement of a radiating area, taken over that area. Therefore, an acoustic projector must have a large radiating area, or a large displacement, or both. It is beneficial to have a projector with an output that varies linearly with the projector input.

The term "push-pull" as used herein and in the appended claims refers to a mode of operation of a pair of electrostrictive annular rings, in which the rings are in abutting relation to one and the other faces of a plate. The rings operate in unison, but oppositely, such that one ring "pushes" the plate, while the other ring simultaneously "pulls" the plate. Such an arrangement is commonly referred to as a "push-pull" projector, or transducer. The mode of excitation produced thereby is termed "flexural excitation" which is the direct result of bending moment.

U.S. Pat. No. 3,725,856 to Chevenak illustrates a push-pull transducer. In the Chevenak device, the driver plate is not attached to the walls of a hollow cylinder formed by a plurality of walls.

In recent years, consideration has turned to electrostrictive rings of lead magnesium niobate (PMN) and lead magnesium niobate-lead titanate (PMNPT) ceramics. For example, U.S. Pat. No. 5,359,252 to Swift et al. discloses an actuator in which a stack of lead magnesium niobate crystals are free to expand longitudinally within a cylindrical casing to act on a piston. U.S. Pat. No. 5,493,165 to Smith et al. discloses a driver for electrostrictive actuators in which rings of lead magnesium niobate are interleaved with electrode rings to form a stack.

Lead magnesium niobate and lead magnesium niobate-lead titanate have recently gained wide interest in the underwater acoustics transduction community due to the propensity of these materials to exhibit large strains at relatively modest electric field levels. One difficulty with these materials, however, is that the observed strains exhibit a nonlinear response to the applied drive voltage. That is, harmonics of the drive frequency appear in the response of the material. However, the nonlinearity of both PMN and PMNPT is known to exhibit a primarily quadratic response of the strain to the applied drive. See K. M. Rittenmeyer, "Electrostrictive Ceramics for Underwater Transducer Applications," J. Acoust. Soc. Am. 95, pp. 849–856 (1994). This quadratic behavior has been shown to permit the application of a revised Hunt electrostatic transducer model (F. V. Hunt, *Electroacoustics*, John Wiley & Sons, New York, 1954, pp. 176–177) to understanding the behavior of a PMN or PMNPT-based transducer. See J. C. Piquette, "A Fully Mechanical Transducer Model With Application to Generalizing the Non-Linear Hunt Electrostatic Transducer for Harmonic and Transient Suppression," J. Acoust. Soc. Am. 98, pp. 422–430 (1995). Since PMN and PMNPT behave in a manner similar to a Hunt electrostatic transducer, concepts applicable to linearizing an electrostatic transducer are also applicable to developing a linear underwater projector which utilizes either a PMN and/or PMNPT active element. Hence, applicant has recognized the concept of push-pull electrostatic loudspeaker is applicable to the development of a push-pull underwater projector using PMN and/or PMNPT. It has also been recognized that since the properties of PMN are sensitive to the operating environmental conditions, it is also important to correct the operation of a PMN-based projector for variations in environmental conditions.

The operation of an electrostatic loudspeaker is based on the push-pull principle. This principle produces cancellation of nonlinear responses that arise from a quadratic nonlinearity. The push-pull electrostatic loudspeaker operates in a mode which attempts to maintain a constant charge on a pair of balanced moving plate capacitors which share a common moving plate. It has been recognized by applicant that an underwater projector using a PMN and/or PMNPT active element can also be designed to take advantage of the push-pull concept, and hence can also produce a linearized output in a manner similar to an electrostatic loudspeaker.

SUMMARY OF THE INVENTION

Accordingly, an object of the present invention is to provide an underwater acoustic projector which provides a high-amplitude, low-frequency, linear, underwater sound.

A further object of the present invention is to provide an underwater acoustic projector whose operation is more hydrostatic-pressure insensitive.

Yet a further object of the present invention is to provide an underwater acoustic projector as above which results directly in a highly desirable monopole radiation.

The foregoing objects are attained by the underwater acoustic projector of the present invention.

An underwater acoustic projector in accordance with the present invention comprises an inner housing formed from a rigid material, a fixed plate secured to the inner housing, a first annular electrostrictive ring and a second annular electrostrictive ring positioned on one side of the fixed plate, and a third annular electrostrictive ring and a fourth annular electrostrictive ring positioned on a second side of the fixed plate. The first and second annular rings are separated by a first moving plate, while the third and fourth annular rings are separated by a second moving plate. Both moving plates are connected to a respective drive piston which contacts an inner surface of an outer housing surrounding the inner housing and spaced therefrom. The annular rings are formed from lead magnesium niobate or lead magnesium niobate-lead titanate and are wired for dual push-pull operation to reduce the non-linearity of the response of the PMN type material rings.

Other details of the underwater acoustic projector of the present invention, as well as other objects and advantages attendant thereto, are set forth in the following description and drawings.

BRIEF DESCRIPTION OF THE DRAWINGS

Reference is made to the accompanying drawings in which is shown an illustrative embodiment of the invention, from which its novel features and advantages will be apparent.

In the drawings.

DESCRIPTION OF THE PREFERRED EMBODIMENT(S)

Figure 1:
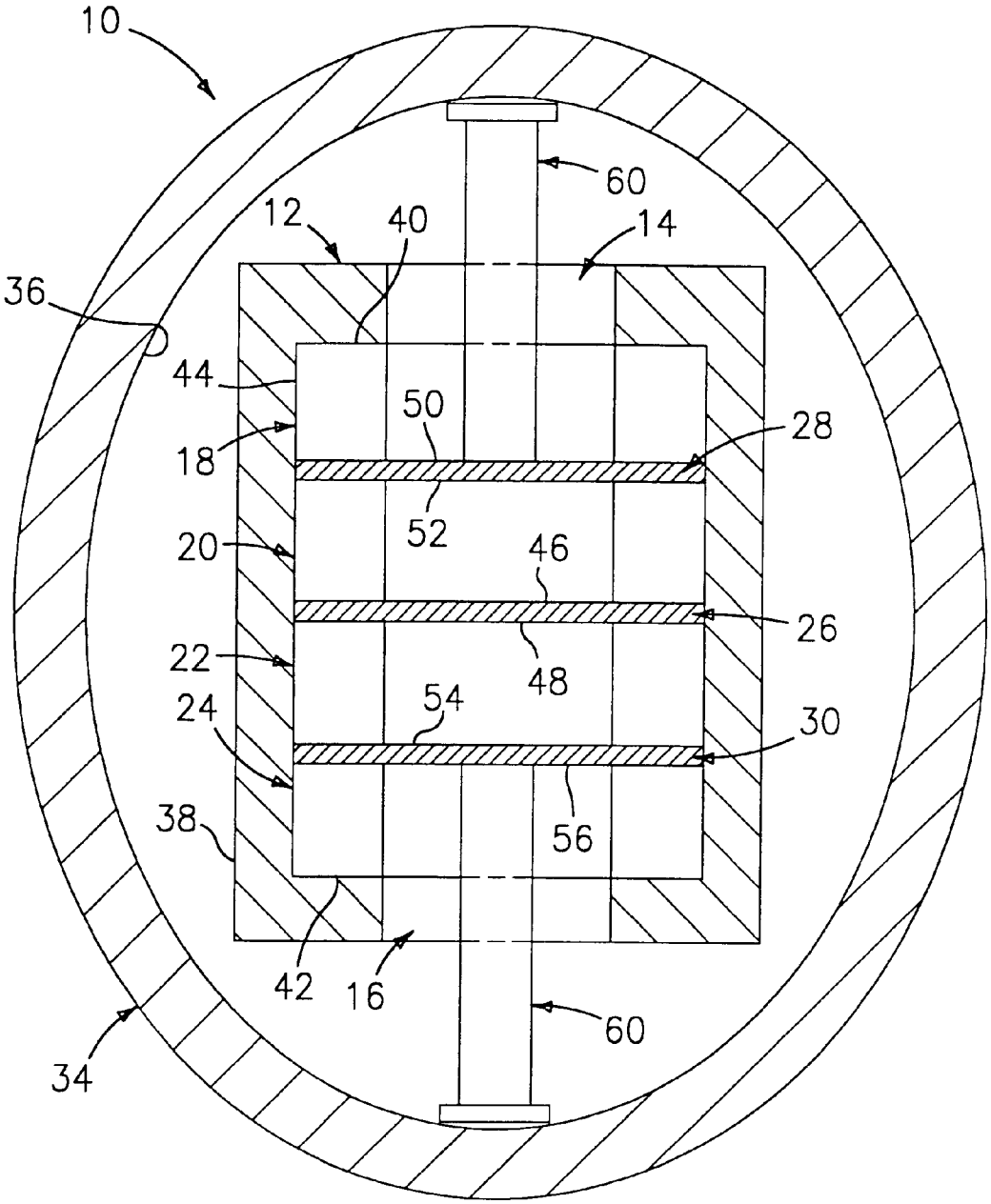
FIG. 1 is a sectional view of one form of an underwater acoustic projector illustrative of an embodiment of the invention.

Referring to FIG. 1, it will be seen that the illustrative underwater acoustic projector 10 has an inner housing 12 formed from a rigid metallic material such as stainless steel. The inner housing 12 includes spaced apart apertures 14 and 16. A plurality of annular, electrostrictive rings 18, 20, 22 and 24 of PMN type material, preferably lead magnesium niobate or lead magnesium niobate-lead titanate, are positioned within the housing 12. The rings 18, 20, 22 and 24 are wired for dual "push-pull" operation with annular rings 18 and 20 forming one push-pull pair and annular rings 22 and 24 forming a second push-pull pair.

The flat surfaces 40 and 42 of rings 18 and 24 are in contact with and bonded to the inner housing 12 so as to prevent motion of these surfaces. Thus, it is important that the inner housing 12 be sufficiently rigid to prevent motion of the flat surfaces 40 and 42 of the rings 18 and 24. The circumferential portions 44 of the rings 18 and 24 are left unbonded so as to not inhibit motion.

The acoustic projector 10 further includes a flat plate 26 which is fixed in position in the inner housing 12. The plate 26 may be fixed in place using any suitable means known in the art and may be formed from any suitable rigid material known in the art such as stainless steel. The surfaces 46 and 48 of the PMN type material annular rings 20 and 22 which are in contact with the plate 26 are bonded to it, again to prevent motion, while the circumferential portions are left unbonded.

The acoustic projector 10 further includes two moving plates 28 and 30. Moving plate 28 is positioned between the annular rings 18 and 20. The flat surfaces 50 and 52 of the annular rings 18 and 20 respectively in contact with the moving plate 28 are bonded to it. In a similar fashion, moving plate 30 is positioned between the annular rings 22 and 24 and the flat surfaces 54 and 56 of the rings 22 and 24 respectively in contact with the plate 30 are bonded to it. In operation, the moving plates 28 and 30 are free to move in response to the forces applied to it by each ring bonded to it.

A drive piston 60 passes through each of the apertures 14 and 16 in the inner housing 12 and is attached to a respective one of the moving plates 28 and 30. Each drive piston 60 may be connected to the moving plate 28 or 30 in any suitable manner using any suitable means known in the art.

An outer housing 34 surrounds the inner housing 12 and has inner surfaces 36 which are spaced from outer surfaces 38 of the inner housing 12. As shown in FIG. 1, the inner surfaces 56 of the outer housing 54 are contacted by the pistons 60. The outer housing 34 is also fabricated from metal; however, the thickness of the metal is chosen such that flexure is not inhibited. This is because this is the basis upon which a flextensional transducer operates.

Figure 2:
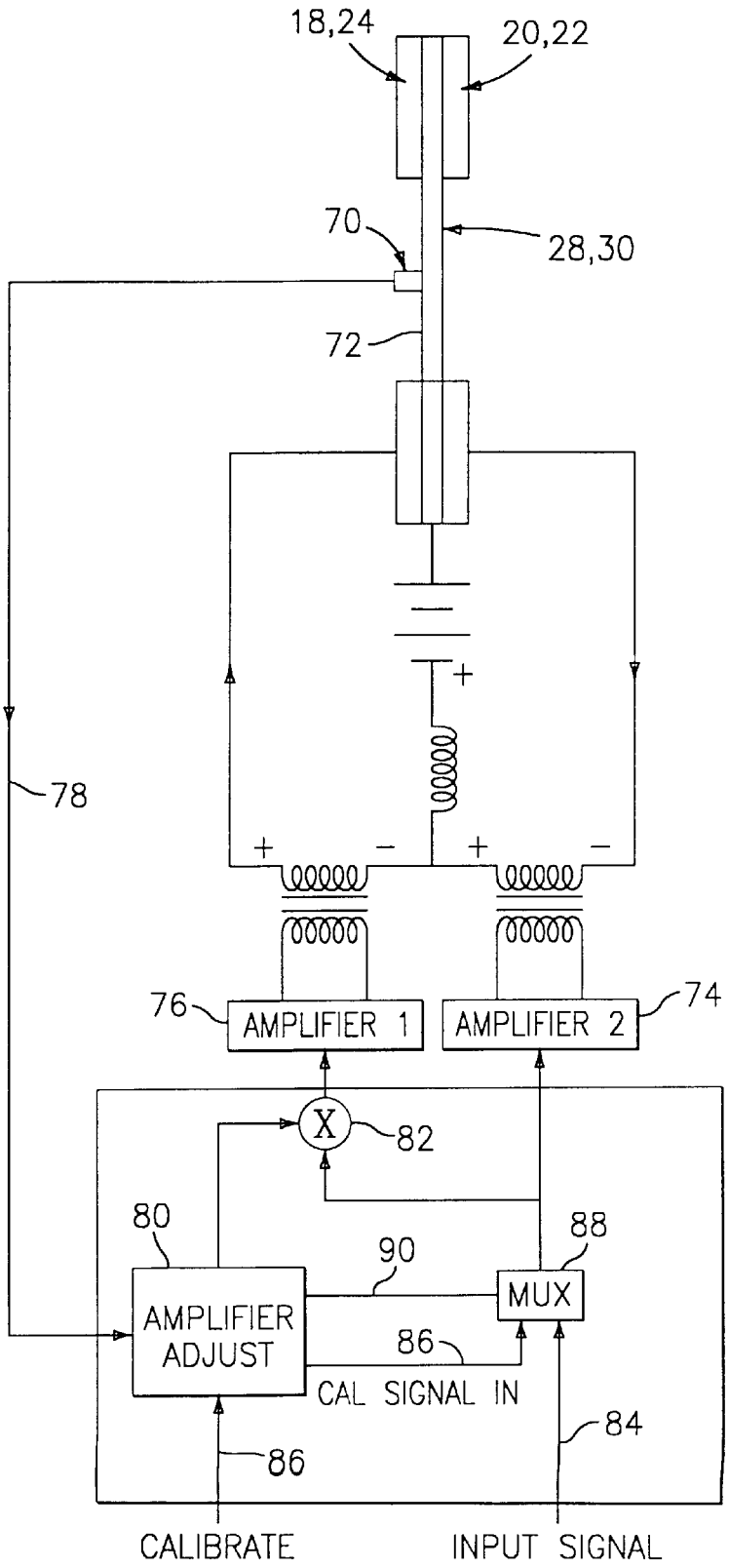
FIG. 2 is a schematic diagram illustrative of an electrical circuit for each push-pull pair in the projector of FIG. 1.

The acoustic projector 10 is wired for dual push-pull operation as shown in FIG. 2. This means that when the sections defined by the rings 18 and 24 contract, the sections defined by the rings 20 and 22 expand, and vice versa. Each of the two moving plates 28 and 30 represent radiating faces of the projector 10. When operated as described herein, the moving plates 28 and 30 move away from or toward the fixed plate 26 in unison, thus producing monopole radiation and flexure of the outer housing 34.

An important factor in the successful operation of the projector of the present invention is that it be driven with a power amplifier operated in the constant-current mode. The cancellation of harmonics that results from driving a non-linear device in a push-pull manner occurs only when the device exhibits a quadratic nonlinearity. The nonlinearity of PMN type materials is quadratic in the charge, but not in the voltage. Thus, the present device will only operate in a linear manner when the power amplifier is driven in the constant-current, i.e. constant-charge, mode.

The push-pull configuration of the present invention results in the linearization of the response if the PMN sections are balanced. FIG. 2 illustrates a circuit which can be used for driving each push-pull pair in the acoustic projector 12. To compensate for any lack of balance, there is provided an accelerometer 70 adjacent a face 72 of each of moving plates 28 and 30. The accelerometers 70 are adapted to detect the waveform of the drive currents supplied to the plate 28 by the rings 18 and 20 and to the plate 30 by the rings 22 and 24, and thereby applied to rings 18, 20, 22, and 24, by constant-current power amplifiers 74, 76, or other signal sources. It is important that constant-current power amplifiers be used, and not constant-voltage power amplifiers, since the response of PMN bears a quadratic relationship to the current, but not the voltage. Each accelerometer 72 is operative to provide feedback inputs through line 78 to an amplifier adjust control box 80. The control box 80 effects selection of an appropriate multiplier 82 for an input signal 84. If the drive rings 18, 20, 22 and 24 in each pair are perfectly balanced, the multiplier selected is 1.

To set up a multiplier, the projector 10 is placed in its operative environment and a calibrate signal 86 is entered in the control box 80. The control box 80 forwards the calibrate signal to an input multiplexer 88, and shuts off any input signal 84. A sinusoidal test tone 90 is then sent through the multiplexer 88 and the constant-current power amplifiers 74, 76 to the rings 18, 20, 22, and 24. The signals returning through line 78 from each accelerometer 70 are monitored by control box 80 which adjusts the multiplier 82 until a second harmonic of the acceleration of the plates 28, 30 is a minimum. The multiplier value is then stored in a non-volatile memory and used for all subsequent operations of the projector 10 until the next calibration is undertaken. A calibration process takes about five seconds or less. Once the multiplier is set, the constant-current power amplifiers 74, 76 produce substantially identical sinusoidal signals of opposite polarity and unequal in amplitude, such that the waveshape of an acoustic signal produced by each plate 28, 30 becomes that of a pure monofrequency sinusoid.

In a preferred embodiment, the acoustic projector 10 is wired so that a DC bias appears across all four PMN type material annular-ring sections depicted in FIG. 1. Each of the two moving plates 28 and 30 is biased with the same polarity. The fixed plate 26 and the housing 12 are also biased with the same polarity, but opposite to that of the moving plates. For example, if the moving plates 28 and 30 are biased positively, then the inner housing 12 and the fixed plate 26 would be biased negatively.

Electrical insulation (not shown) would have to be applied to each moving plate 28 and 30 to prevent electrical shorting with the inner housing 12 through any oil which is contained between the inner and outer housings to exclude internal air to reduce hydrostatic sensitivity. If desired, the entire inner housing 12 and the outer housing 34 could also receive treatments of electrical insulation.

An AC signal voltage also is wired preferably so that the total voltage (DC+AC) across the rings 18 and 24 would decrease at the same time that the total voltage across rings 20 and 22 would increase, and vice versa as the AC signal reverses polarity. The DC bias source would have to be wired to the two moving plates through a protective resistor sufficiently large to prevent changes in the total charge on these moving plates. This is accomplished by choosing a protective resistance such that the RC time constant computed for it and the capacitance of the device is large compared with the period of the AC signal. Similarly, protective capacitances would have to be wired in series with the AC signal source(s) to prevent feed-through of the DC bias into the AC amplifier(s).

The constant-current amplifiers 74, 76 are each a standard amplifier device that provides as output an amplified version of an input current signal. An example is the model L6 amplifier manufactured by Instruments, Inc. of San Diego, Calif. This device can be operated as a current amplifier, as required here, or as either a voltage or resistive source, through the operation of a selector switch on the amplifier's front panel.

An important feature of the acoustic projector of the present invention is the fact that this device contains no air cavities. Hence, its operation is much more hydrostatic-pressure insensitive. Moreover, the dual push-pull configuration of the present device results directly in a highly desirable monopole radiation. Still further, the flextensional design described herein results in a natural lowering of the resonance frequency and increase of the surface displacement, resulting in enhanced low-frequency output of the projector of the present invention.

Typical dimensions of the stack described herein would be approximately 3 inches total stack height for each of the two stacks involved in the push-pull design. The number of PMN rings in each stack could readily be increased to enhance performance if required. Typical lateral dimensions would involve approximately a 2-inch diameter of the stack. The entire length of the device would be approximately 8 inches. Design goals of interest would produce a device that operates in the frequency range of 500–3000 Hz.

It is apparent that there has been provided in accordance with the present invention a flextensional dual-section push-pull underwater projector which fully satisfies the means, objects and advantages set forth hereinbefore. While the invention has been described in combination with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. An underwater acoustic projector comprising:

an inner housing formed from a rigid material;

an outer housing surrounding said inner housing;

a fixed plate secured to said inner housing;

first and second annular electrostrictive rings positioned on one side of said fixed plate;

third and fourth annular electrostrictive rings positioned on a second side of said fixed plate;

said first and second annular rings being separated by a first moving plate;

said third and fourth annular rings being separated by a second moving plate;

means for producing a monopole radiation by causing said first and second movable plates to move away from or toward said fixed plate in unison; and means for causing flexure of said outer housing attached to each of said moving plates as a result of said movement of said moving plates.

2. The underwater acoustic projector of claim 1, wherein said means for producing a monopole radiation comprises said annular rings being wired for dual push-pull operation.

3. The underwater acoustic projector of claim 1, wherein said annular rings are formed from a material selected from a group consisting of (1) lead magnesium niobate and (2) lead magnesium niobate-lead titanate.

4. The underwater acoustic projector of claim 1, wherein said housing and said fixed plate are formed from a rigid metallic material.

5. The underwater acoustic projector of claim 4, wherein said rigid metallic material comprises stainless steel.

6. The underwater acoustic projector of claim 1, wherein flat surfaces of said first and fourth annular rings in contact with said inner housing are bonded to said inner housing.

7. The underwater acoustic projector of claim 1, wherein surfaces of the second and third annular rings in contact with said fixed plate are bonded to said fixed plate.

8. The underwater acoustic projector of claim 1, wherein the flat surfaces of the first and second annular rings in contact with the first moving plate are bonded to the first moving plate.

9. The underwater acoustic projector of claim 1, wherein the flat surfaces of the third and fourth annular rings in contact with the second moving plate are bonded to the second moving plate.

10. The underwater acoustic projector of claim 1, wherein said means for producing a monopole radiation further comprises a power amplifier operated in a constant current mode for driving said projector.

11. The underwater acoustic projector of claim 1, wherein said means for causing flexing of said outer housing comprises a drive piston attached to each of said moving plates.

* * * * *